US010349689B2

(12) United States Patent
Mills

(10) Patent No.: US 10,349,689 B2
(45) Date of Patent: Jul. 16, 2019

(54) FIVE FINGER FOAM ADJUSTABLE HAND

(71) Applicant: Mark Alan Mills, Ames, IA (US)

(72) Inventor: Mark Alan Mills, Ames, IA (US)

( * ) Notice: Subject to any disclaimer, the term of this patent is extended or adjusted under 35 U.S.C. 154(b) by 52 days.

(21) Appl. No.: 15/609,820

(22) Filed: May 31, 2017

(65) Prior Publication Data

US 2017/0347725 A1 Dec. 7, 2017

Related U.S. Application Data

(60) Provisional application No. 62/344,223, filed on Jun. 1, 2016.

(51) Int. Cl.

| | |
|---|---|
| ***A41D 19/00*** | (2006.01) |
| ***A63H 33/00*** | (2006.01) |
| ***A63H 37/00*** | (2006.01) |
| *G09F 21/02* | (2006.01) |

(52) U.S. Cl.

CPC ..... *A41D 19/0013* (2013.01); *A41D 19/0051* (2013.01); *A63H 33/00* (2013.01); *A63H 37/00* (2013.01); *G09F 21/02* (2013.01); *G09F 21/026* (2013.01)

(58) Field of Classification Search

CPC ..... A41D 19/0013; A41D 19/0051; A63H 37/00; A63H 33/00

See application file for complete search history.

(56) References Cited

U.S. PATENT DOCUMENTS

| | | | | |
|---|---|---|---|---|
| 4,455,963 | A | 6/1984 | Matsuo | |
| D364,357 | S * | 11/1995 | Ledgerwood, II | D10/33 |
| 6,035,444 | A * | 3/2000 | McGrew | A41D 19/0017 2/16 |
| 6,612,056 | B1 | 9/2003 | Thomas, II | |
| 2013/0118045 | A1 | 5/2013 | Sample et al. | |
| 2016/0042674 | A1 * | 2/2016 | Camarella | G09F 21/02 446/26 |

OTHER PUBLICATIONS

"Foam Cheering Hand W/2 Fingers", http://www.oempromo.com/product/Foam/F/Foam-Cheering-Hand-W-2-Fingers-88866.htm, Promo Industrial Co., Limited, 1 page, accessed online Aug. 29, 2017.

European Patent Office, "Notification of Transmittal of the International Search Report and the Written Opinion of the International Searching Authority, or the Declaration" filed in connection to PCT/US2017/035220, dated Sep. 8, 2017.

* cited by examiner

*Primary Examiner* — Cassandra Davis

(74) *Attorney, Agent, or Firm* — McKee, Voorhees & Sease, PLC

(57) ABSTRACT

A foam hand is provided with the fingers and thumb extended outwardly in an open hand gesture. The hand includes a plurality of openings or slots into which the fingers and thumb can be selectively inserted for retention, and thereby configure the hand in multiple gestures. The base of the hand includes a slot or pocket into which a user can insert his/her hand so as to wear the foam hand over their own hand.

18 Claims, 10 Drawing Sheets

FIVE FINGER FOAM ADJUSTABLE HAND

CROSS-REFERENCE TO RELATED APPLICATIONS

This application claims priority under 35 U.S.C. § 119 to provisional application Ser. No. 62/344,223, filed Jun. 1, 2016, herein incorporated by reference in its entirety.

FIELD OF THE INVENTION

This invention relates to a visual display device for use at indoor and outdoor sporting events, and other activities such as those in a stadium, gymnasium, arena, ball park, race track, velodrome, aquatic center, and other venues.

BACKGROUND OF THE INVENTION

Foam hand having a raised index finger to form a number 1 hand gesture are well known. Such hands are commonly used at sporting events and other venues. These prior art foam hands are substantially larger than a person's hand and include a lower slot or pocket into which a user can insert their hand, with the index finger extending upwardly so as to indicate, for example, that their team is number one. These conventional hands are not adjustable or configurable into other gestures, but rather are static in the fixed state of the number 1 gesture. Therefore, users are limited in their display of thoughts and emotions by the non-adjustable foam hand.

Therefore, a primary objective of the present invention is the provision of a foam hand which can be configured into multiple hand gestures.

Another objective of the present invention is the provision of a foam hand with a thumb and four fingers which can be independently folded into different hand gestures.

A further objective of the present invention is the provision of an enlarged foam hand wherein the fingers can be quickly and easily manipulated to various configurations.

Still another objective of the present invention is a foam hand wherein the thumb and fingers can be moved to display various thoughts and emotions.

Another objective of the present invention is the provision of a multi-gesture foam hand.

Yet another objective of the present invention is of an adjustable foam hand which is economically manufactured, and durable and safe in use.

These and other objectives will become apparent from the following description of the invention.

SUMMARY OF THE INVENTION

A dynamic foam hand is provided with a thumb and four fingers which can be manipulated into different hand gestures. The foam hand is worn over a user's own hand, and is substantially larger than the user's hand so as to be visible from a substantial distance. The hand includes four opening, one below each of the fingers, into which the fingers can be folded and retained. The thumb includes a hole near the tip to allow one of the fingers to be inserted therein for retention. One or more of the fingers may include a hole near the tip for insertion of the thumb or one of the other fingers for retention therein. The holes allow the fingers and thumb to be selectively folded so as to form different hand gestures, as desired by the user.

DETAILED DESCRIPTION OF THE PREFERRED EMBODIMENTS

Figure 1:
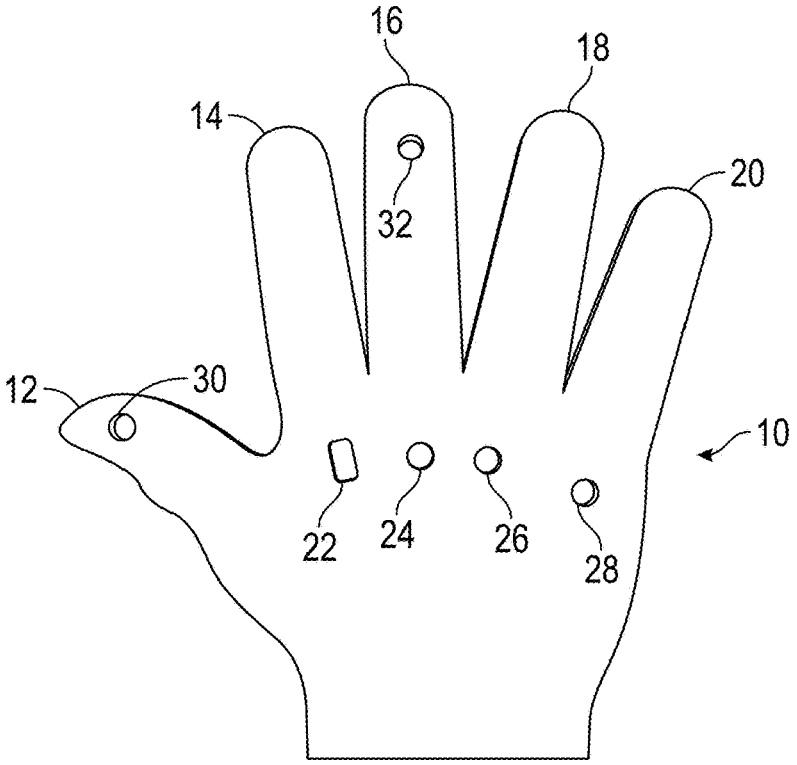
FIG. 1 shows the foldable hand of the present invention, with all the digits extended in first gesture, or configuration.

The foam hand of the present invention is generally designated by the reference numeral 10 in the drawings. The hand 10 is cut using conventional foam cutting technology to form the outline of a hand having the thumb and four fingers in an open or fully extended position, as shown in FIG. 1. Thus, the foam hand 10 includes a thumb 12, an index finger 14, a middle finger 16, a ring finger 18, and a little finger 20.

As best seen at FIG. 1, the hand 10 includes a plurality of slots, holes or openings, which allow the thumb and fingers to be selectively folded and inserted into the holes for retention therein. For example, in the preferred embodiment shown in the drawings, a first hole 22 is provided beneath the index finger 14 adjacent an upper portion of the palm. A second hole 24 is provided beneath the middle finger 16. A third hole 26 is provided beneath the ring finger 18. A fourth hole 28 is provided beneath the little finger 20. Additional holes can be provided in the thumb and/or finger so as to provide additional folding options. For example, as shown in the drawings, a hole 30 is provided in the thumb 12 and a hole 32 is provided in the middle finger 16. The hole 22 is elongated, in a preferred embodiment, to accommodate both the thumb 12 and one of the fingers 14, 16, 18, 20.

Figure 20:
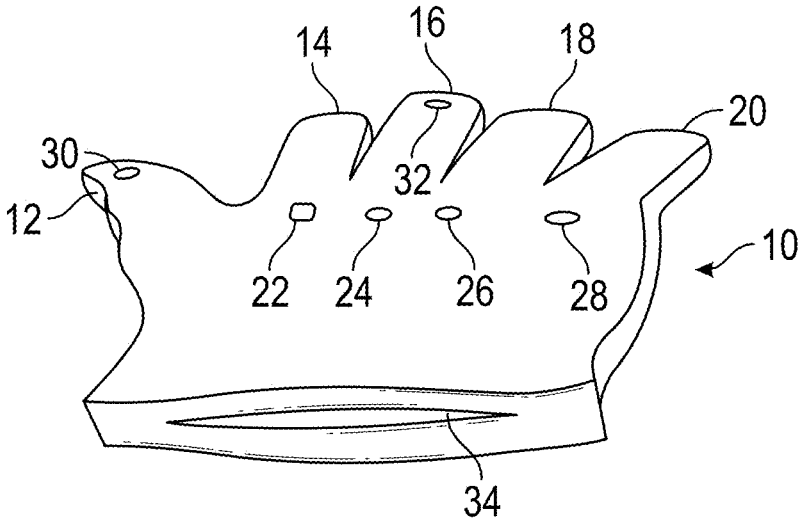
FIG. 20 is a lower perspective of the hand showing the slot or pocket for receiving the user's hand.

As shown in FIG. 20, the hand 10 includes a slot or pocket 34 in the base of the hand. The slot 34 is sized so that a user can insert their own hand into the slot 34 so as to wear the hand 10 over their own hand.

Thus, a user has many options for configuring the hand 10 into multiple gestures, so as to display emotions, thoughts, and alike. For example:

FIG. 1 is a front elevation view of the foam hand 10 with all of the digits extended outwardly in a "high five" gesture.

Figure 2:
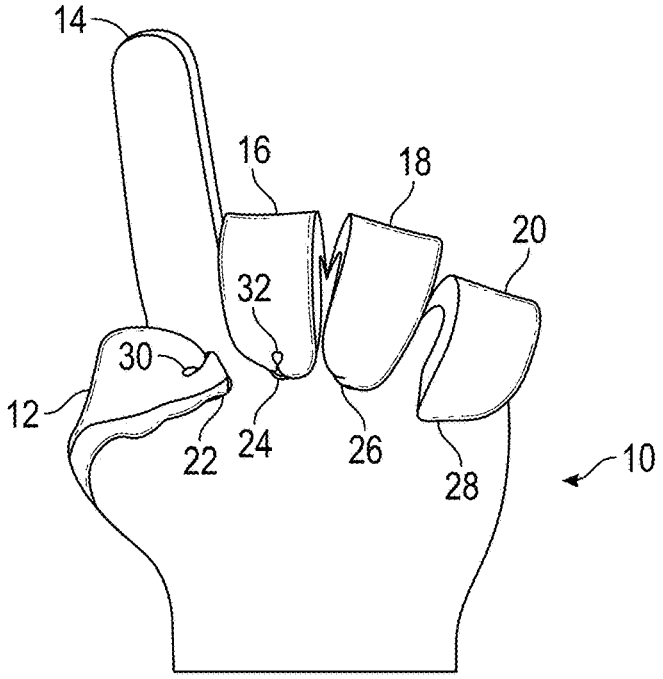
FIG. 2 shows the hand folded into a second configuration.

FIG. 2 is a front elevation view showing the hand 10 folded into a number one gesture, with the index finger 14 extended and the remaining fingers 16, 18, 20 and the thumb 12 folded downwardly.

Figure 3:
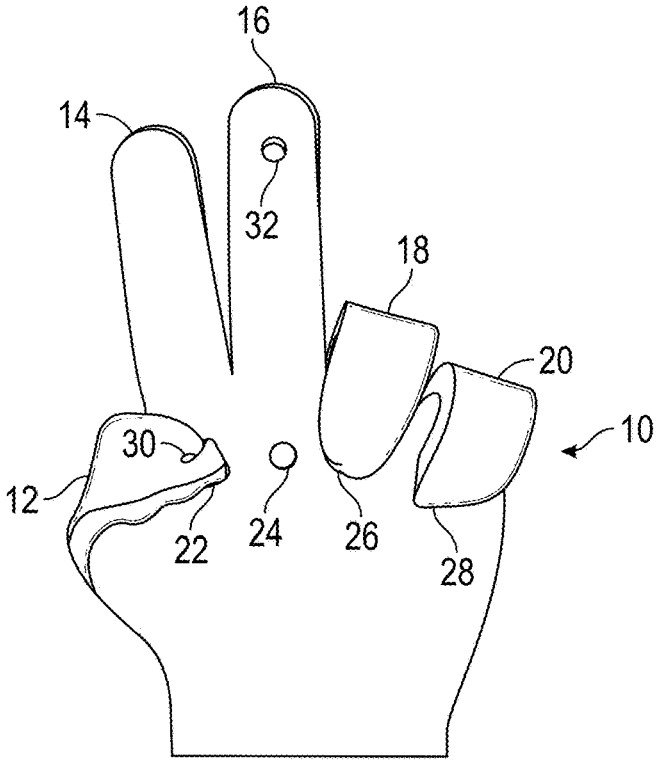
FIG. 3 shows the hand folded into a third configuration.

FIG. 3 is a front elevation view of the hand configured into a number two sign or peace sign, with the fingers 14, 16 extended and the thumb 12 and the fingers 18, 20 folded.

Figure 4:
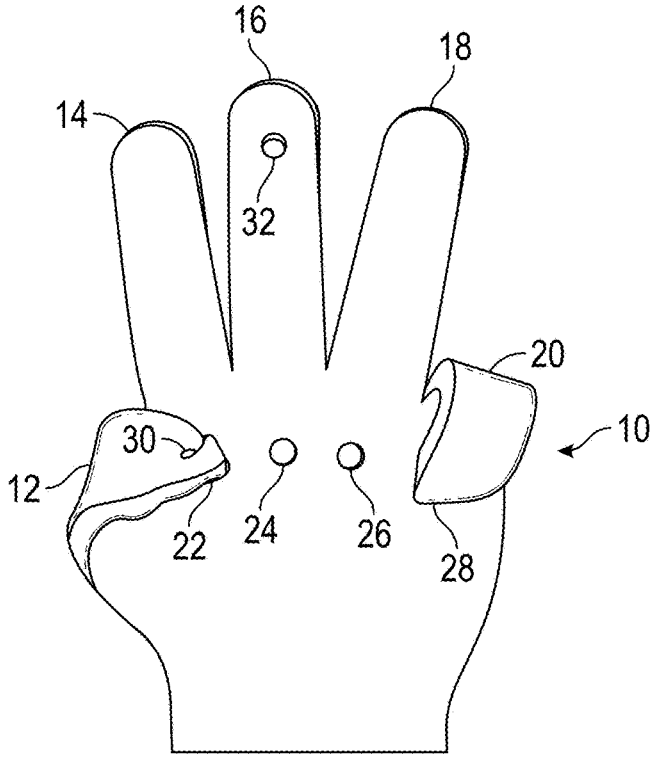
FIG. 4 shows the hand folded into a fourth configuration.

FIG. 4 is a front elevation view of the hand 10 with the index finger 14, middle finger 16, and ring finger 18 extended, and the thumb 12 and the middle finger 16 folded, to display the number three, such as used with a three-point shot.

Figure 5:
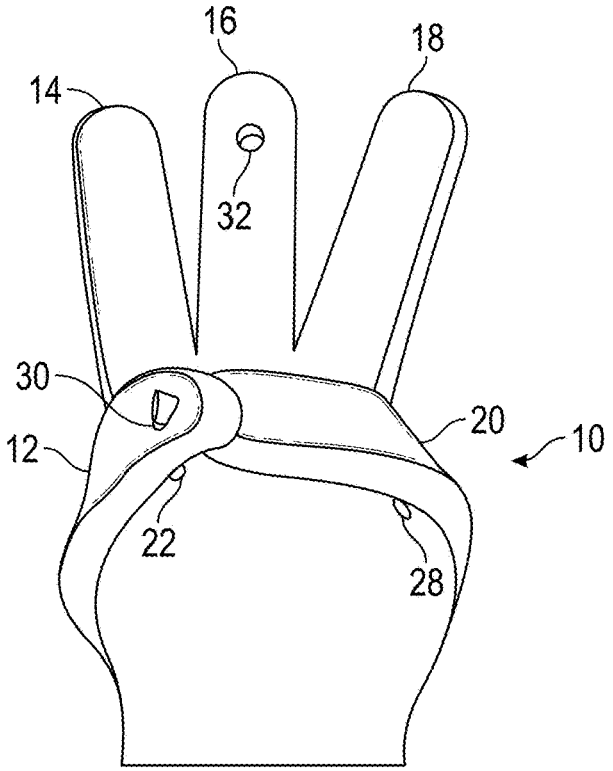
FIG. 5 shows the hand folded into a fifth configuration.

FIG. 5 is a front elevation view of the hand 10 with the thumb 12 and the little finger 20 joined together and the remaining fingers 14, 16, 18 extended.

Figure 6:
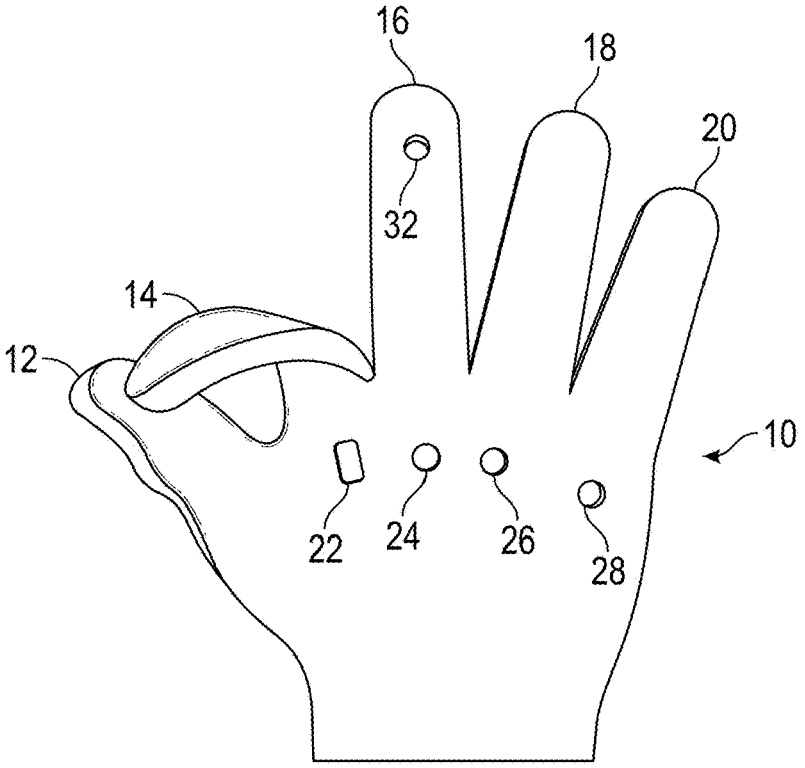
FIG. 6 shows the hand folded into a sixth configuration.

FIG. 6 is a front elevation view of the hand 10 showing a further number three configuration, or an "OK" sign, with the thumb 12 and the index finger 14 joined together, and the remaining fingers 16, 18, 20 extended.

Figure 7:
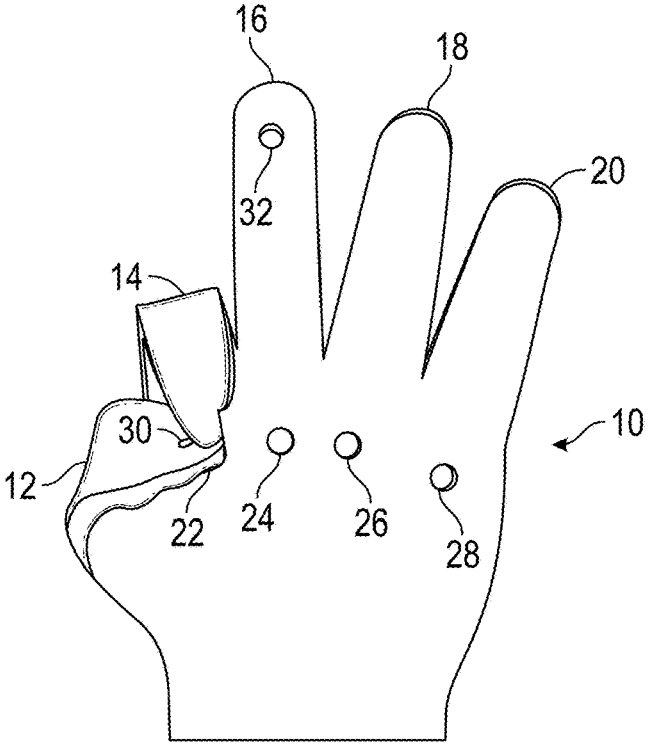
FIG. 7 shows the hand folded into a seventh configuration.

FIG. 7 is a front elevation view of the hand 10 showing yet another alternative configuration for number three, with middle finger 16, ring finger 18, and little finger 20 extended, and the thumb 12 and the index finger 14 folded downwardly.

Figure 8:
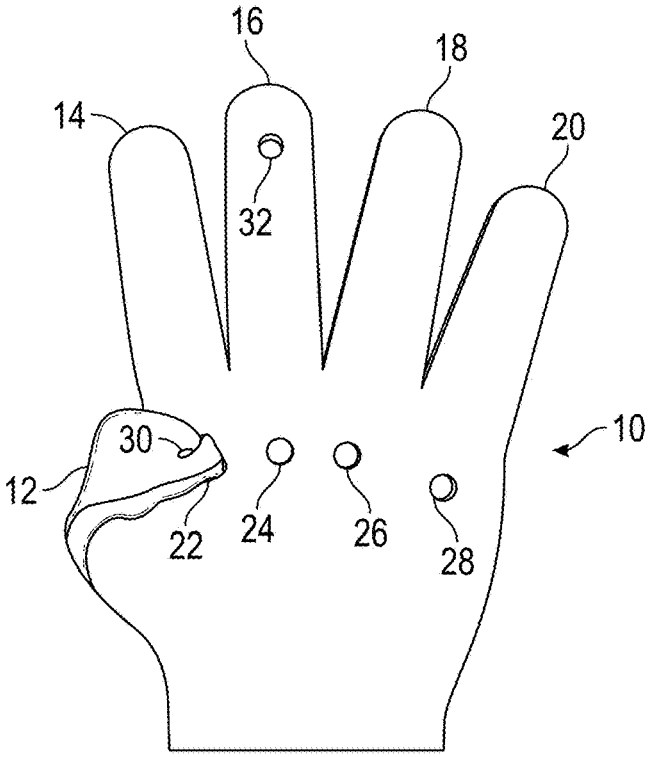
FIG. 8 shows the hand folded into an eighth configuration.

FIG. 8 is a front elevation view of the hand 10 with all four fingers extended, and the thumb 12 folded, to display a number four sign.

Figure 9:
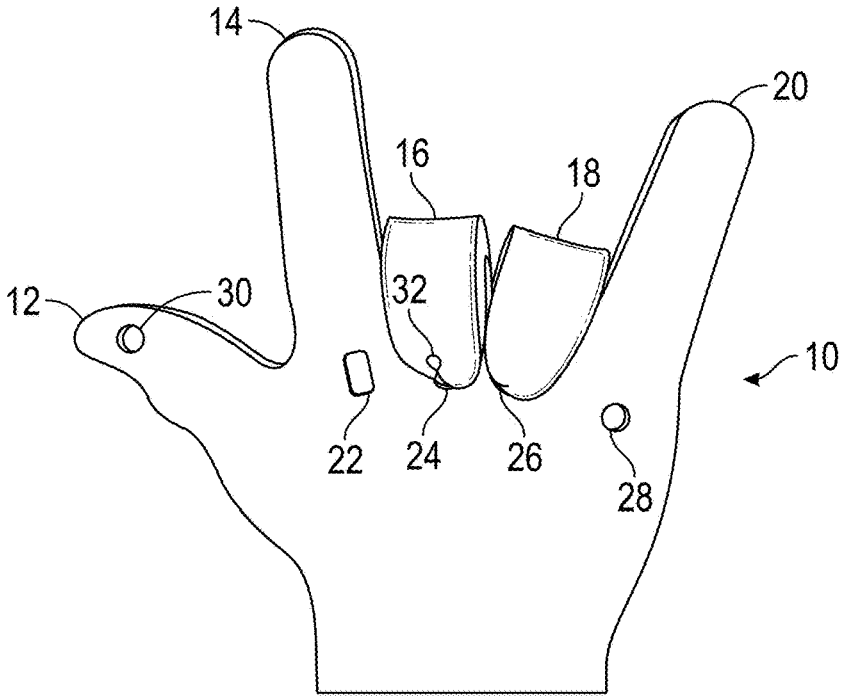
FIG. 9 shows the hand folded into a ninth configuration.

FIG. 9 is a front elevation view of the hand 10 with the middle and ring fingers 14, 16 folded, and with the thumb 12, index finger 14, and little finger 20 extended to an American Sign Language gesture of "I love you."

Figure 10:
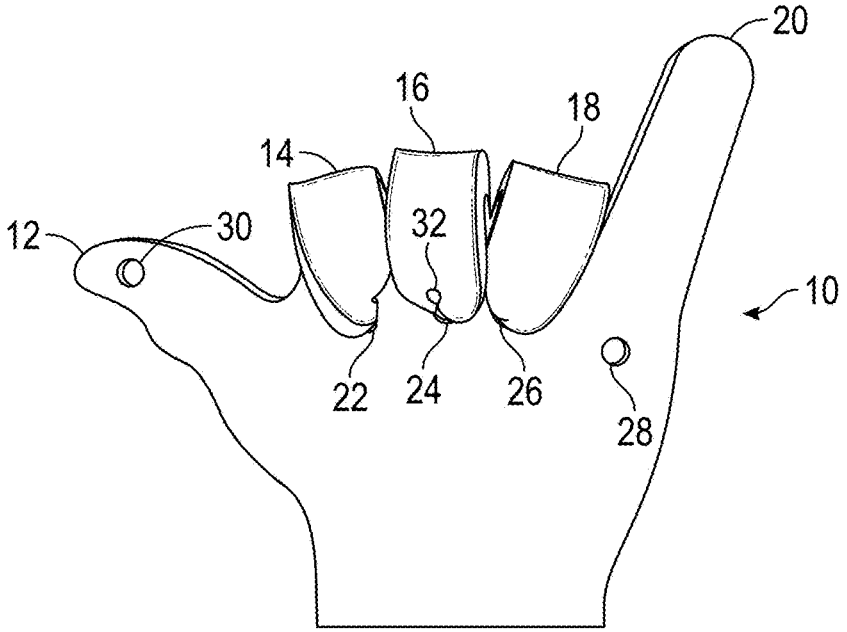
FIG. 10 shows the hand folded into a tenth configuration.

FIG. 10 is a front elevation view of the hand 10 with the index finger 14, middle finger 16 and ring finder 18 folded, and with the thumb 12 and the little finger 20 extended to an American Sign Language gesture indication of "Play" or the University of Texas "Hook 'em Horns" gesture.

Figure 11:
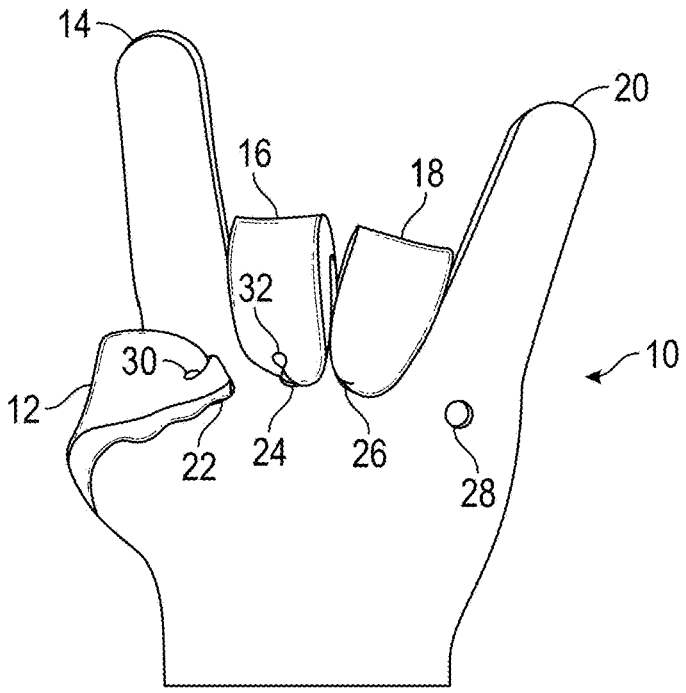
FIG. 11 shows the hand folded into an eleventh configuration.

FIG. 11 is a front elevation view of the hand 10 showing another version of a number two gesture, with the thumb 12, the middle finger 16 and the ring finger 18 folded, and the index finger 14 and the little finger 20 extended.

Figure 12:
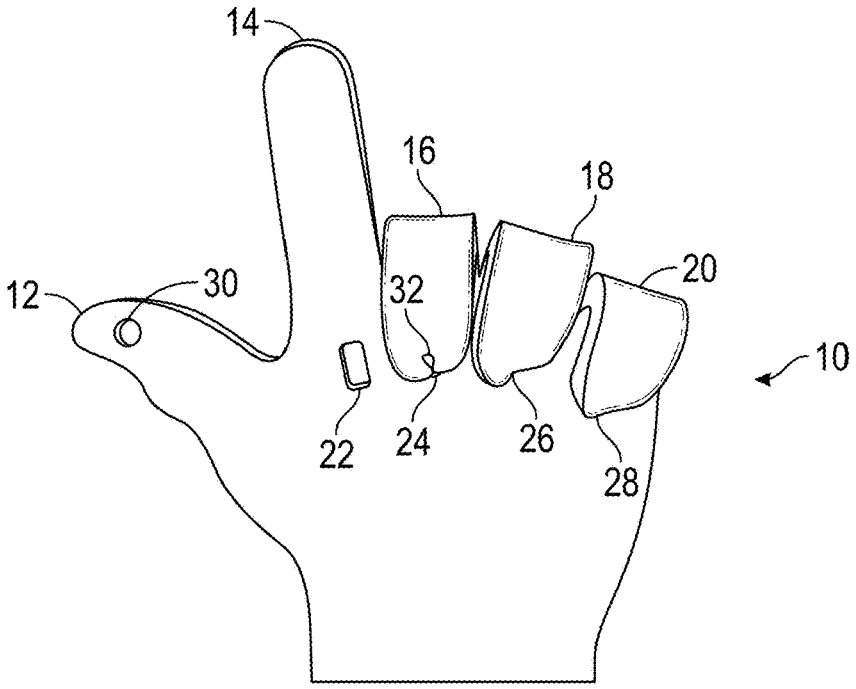
FIG. 12 shows the hand folded into a twelfth configuration.

FIG. 12 is a front elevation view of the hand 10 with the thumb 12 and the index finger 14 extended, and the remaining fingers folded, to represent an L, or a gesture for "Loser."

Figure 13:
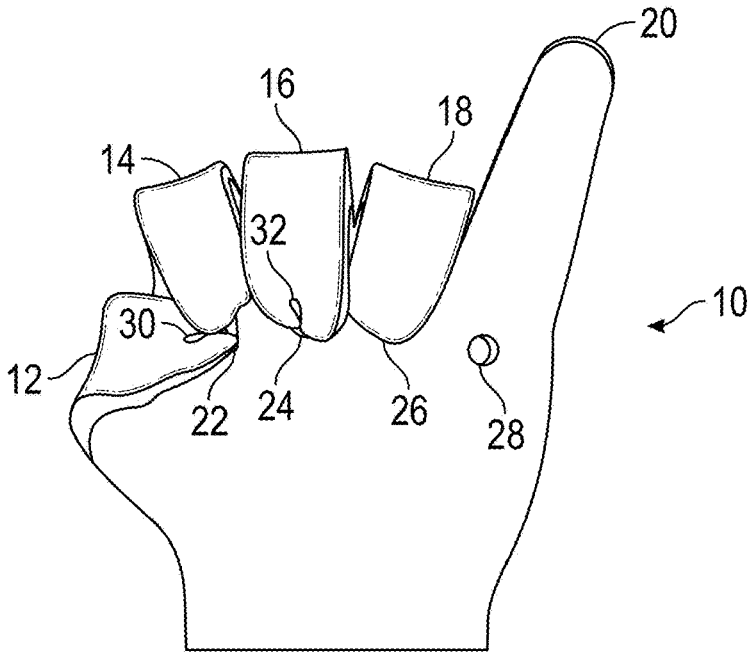
FIG. 13 shows the hand folded into a thirteenth configuration.

FIG. 13 is a front elevation view of the hand 10 with the little finger 20 extended and the remaining digits folded.

Figure 14:
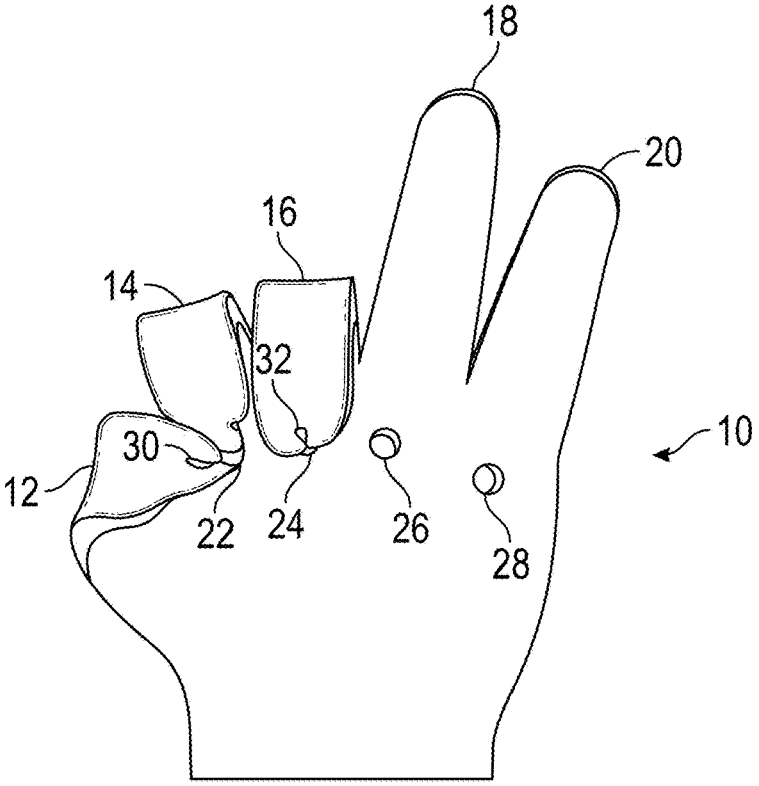
FIG. 14 shows the hand folded into a fourteenth configuration.

FIG. 14 is a front elevation view of the hand with the thumb 12 and fingers 12, 14 folded and the fingers 18, 20 extended.

Figure 15:
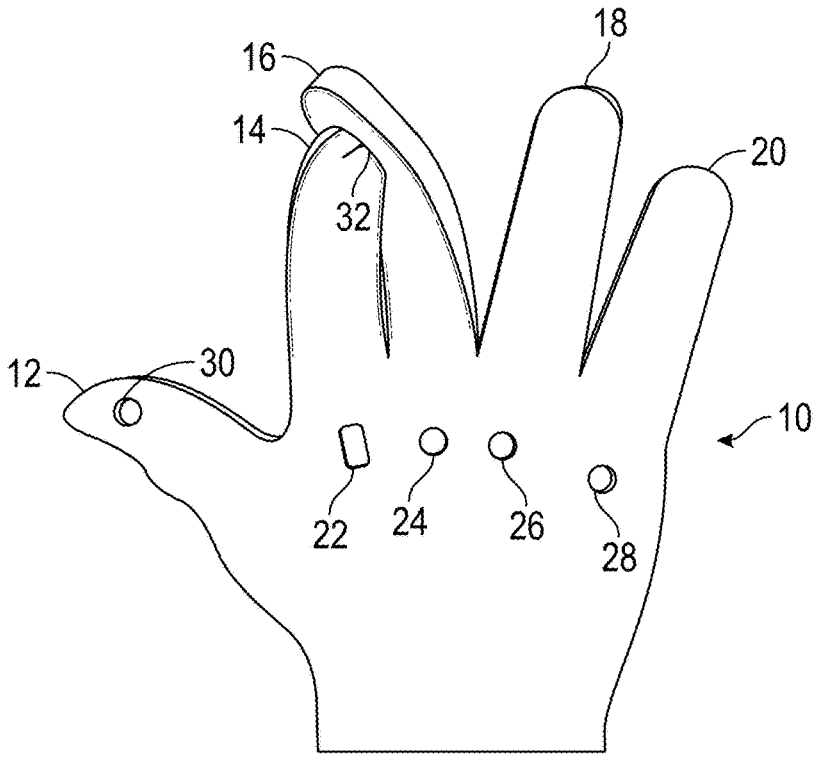
FIG. 15 shows the hand folded into a fifteenth configuration.

FIG. 15 is a front elevation view of the hand 10 showing the index finger 14 inserted into the hole of the middle finger 18 such that the index finger 10 and middle finger 18 appear to be crossed.

Figure 16:
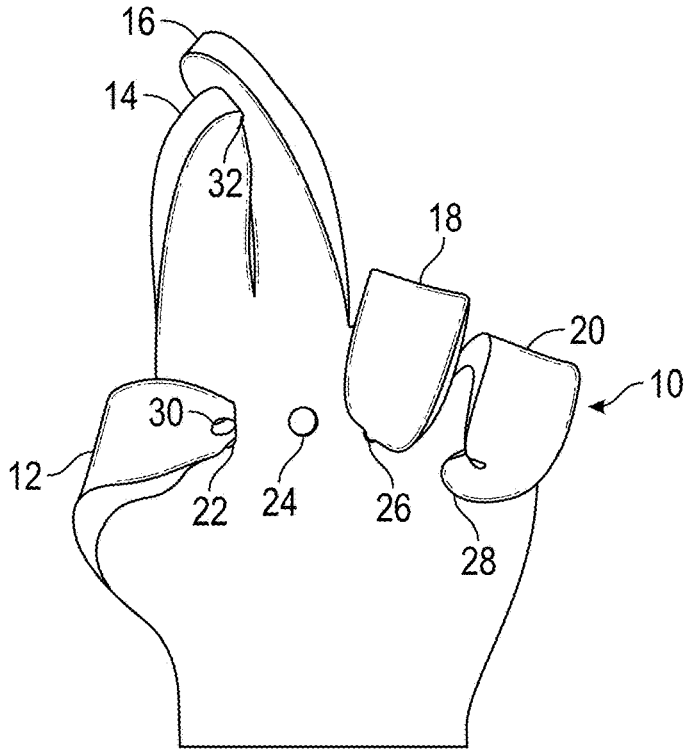
FIG. 16 shows the hand folded into a sixteenth configuration.

FIG. 16 is a front elevation view of the hand 10 wherein the index finger 14 and middle finger 18 are crossed, similar to FIG. 15, with the thumb 12, the ring finger 18, and little finger 20 folded downwardly.

Figure 17:
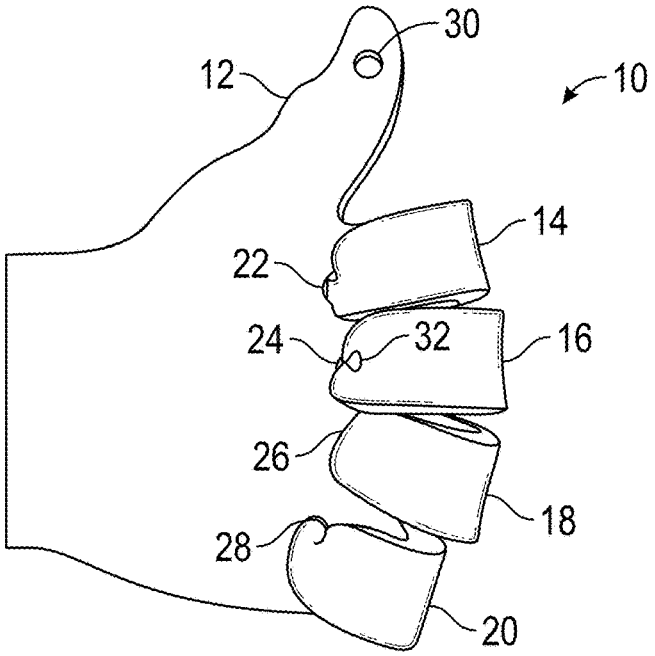
FIG. 17 shows the hand folded into a seventeenth configuration.

FIG. 17 is a front elevation view of the hand 10 with the four fingers folded and the thumb 12 extended upwardly, to indicated a "thumbs up" gesture.

Figure 18:
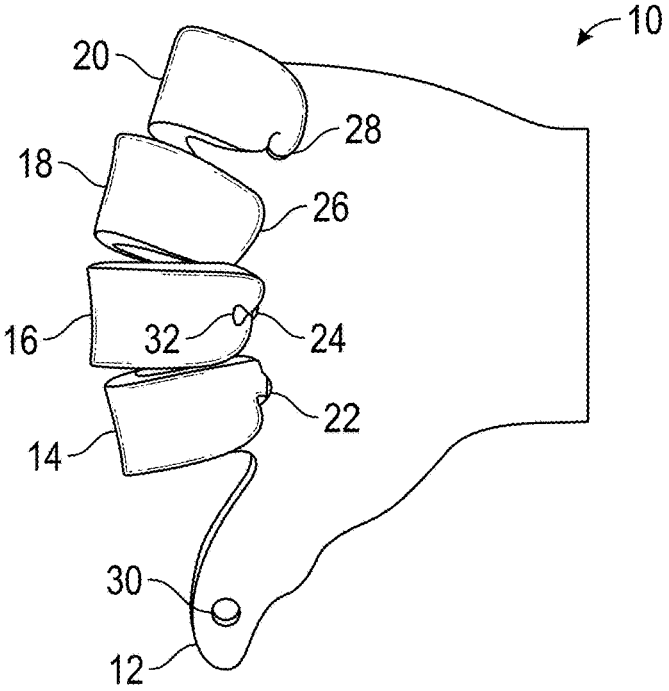
FIG. 18 shows the hand folded into an eighteenth configuration.

FIG. 18 is a view similar to FIG. 17, but with the thumb 12 pointed down in a "thumbs down" gesture.

Figure 19:
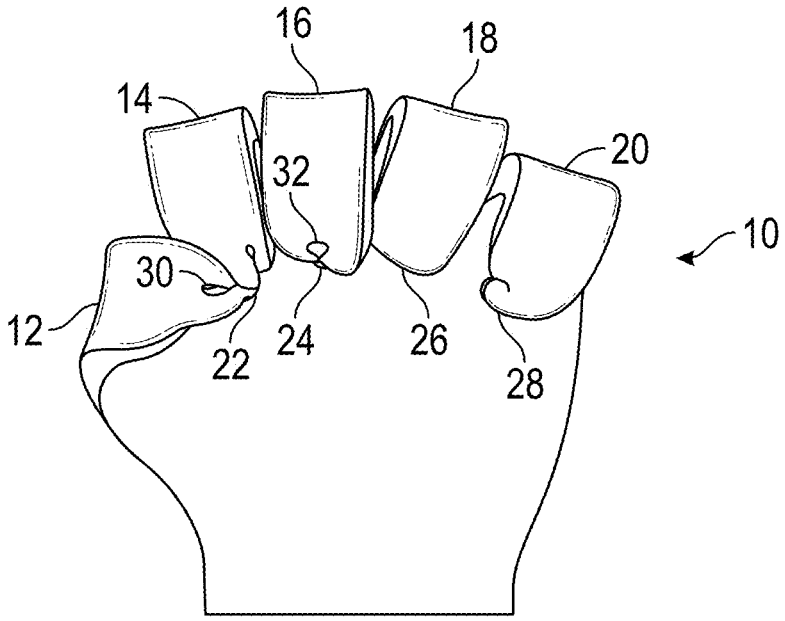
FIG. 19 shows the hand folded into a nineteenth configuration.

FIG. 19 is a front elevation view of the hand 10 with all of the digits folded down to form a first gesture.

The foam hand 10 may also include various markings and indicia printed anywhere on the hand, such as the front or back sides. For example, school names, team names, logos, mascots, word phrases, and other graphics can be printed on the palm region of the hand 10, or on the fingers. The hand 10 can be made any desired color, such as school or team colors. The hands 10 can be made of material other than foam, that will allow folding and unfolding of the fingers and thumb to various configurations.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A foam hand, comprising:

a palm, a thumb and four fingers;

a single hole extending entirely though the hand beneath each of the four fingers;

a single fifth hole extending entirely though the thumb for insertion of one of the fingers;

the thumb and three of the fingers are free of additional holes; and the thumb and four fingers being selectively foldable for insertion into at least one of the holes to create a variety of different hand gestures.

2. The foam hand of claim 1 further comprising a lower slit for insertion of a user's hand.

3. The foam hand of claim 1 further comprising a hole in one of the fingers for insertion of the thumb or one of the other fingers.

4. The foam hand of claim 1 wherein the thumb and fingers are in a spread orientation when the holes are not in use.

5. The foam hand of claim 1 wherein one, two, and/or three of the fingers are foldable to create a gesture with the one, two, and/or three of the fingers extending upwardly.

6. The foam hand of claim 1 wherein all four fingers are foldable to create a thumb up and thumb down gesture.

7. The foam hand of claim 1 wherein the fingers are folded to form American Sign Language gestures.

8. The foam hand of claim 7 wherein an American Sign Language gesture is formed to say, "I love you".

9. The foam hand of claim 1 wherein a tip of one the fingers is inserted into the fifth hole while the remaining fingers are unfolded to form a "OK" gesture.

10. The foam hand of claim 1 wherein the fingers and thumb are foldable to form a fist.

11. A device for creating multiple hand gestures, comprising:

a hand made of pliable material and including a thumb, an index finger, a middle finger, a ring finger, and a little finger;

a first hole below the index finger, a second hole beneath the middle finger, a third hole beneath the ring finger, and a fourth hole beneath the little finger;

the first, second, third and fourth holes extending entirely though the hand;

the fingers being selectively insertable into one of the holes for retention therein so as to form a plurality of hand gestures;

a fifth hole in one of the fingers for insertion of the thumb or one of the other fingers; and the thumb and three of the fingers are free of additional holes.

12. The device of claim 11 wherein the hand is made of foam.

13. The device of claim 11 further comprising a sixth hole in the thumb for insertion of one of the fingers.

14. The device of claim 11 further comprising a lower pocket for insertion of a user's hand.

15. The device of claim 11 wherein the hand is normally configured with the thumb and fingers fully open.

16. The device of claim 11 wherein the first hole is elongated to simultaneously receive the thumb and one of the fingers.

17. The device of claim 11 wherein the fingers and thumb are simultaneously foldable to form a fist.

18. The device of claim 11 wherein the fingers are foldable to form American Sign Language gestures.

* * * * *